US009283492B2

(12) United States Patent
Wechsler

(10) Patent No.: US 9,283,492 B2
(45) Date of Patent: Mar. 15, 2016

(54) FLYING DISK TOY

(71) Applicant: Lawrence I. Wechsler, Great Neck, NY (US)

(72) Inventor: Lawrence I. Wechsler, Great Neck, NY (US)

( * ) Notice: Subject to any disclaimer, the term of this patent is extended or adjusted under 35 U.S.C. 154(b) by 0 days.

(21) Appl. No.: 14/154,775

(22) Filed: Jan. 14, 2014

(65) Prior Publication Data

US 2014/0127963 A1 May 8, 2014

Related U.S. Application Data

(63) Continuation-in-part of application No. 13/072,157, filed on Mar. 25, 2011, now abandoned.

(60) Provisional application No. 61/317,279, filed on Mar. 25, 2010.

(51) Int. Cl.
*A63H 27/00* (2006.01)
*A63H 33/18* (2006.01)

(52) U.S. Cl.
CPC ..... *A63H 33/18* (2013.01)

(58) Field of Classification Search
USPC ..... 446/46, 47, 48, 61, 66, 67; 473/588, 473/589, 590, 596
See application file for complete search history.

(56) References Cited

U.S. PATENT DOCUMENTS

| | | | | | |
|---|---|---|---|---|---|
| 1,683,643 | A | * | 9/1928 | Wittmaak | 473/589 |
| D214,577 | S | * | 7/1969 | Mueller | D21/444 |
| D221,453 | S | * | 8/1971 | Swanberg | D21/444 |
| 3,935,663 | A | * | 2/1976 | Leibowitz | 446/48 |
| 4,132,030 | A | * | 1/1979 | Lehman | 446/46 |
| 4,203,249 | A | * | 5/1980 | Bohm | 446/48 |
| 5,340,347 | A | * | 8/1994 | Yenerich | 446/48 |
| 2011/0287686 | A1 | * | 11/2011 | Wechsler | 446/46 |

* cited by examiner

*Primary Examiner* — Nini Legesse

(57) ABSTRACT

A toy includes a generally disk-shaped body, a periphery of which includes a bottom which lies generally on a plane. The disk-shaped body further includes a series of protrusions on an undersurface of the disk, disposed radially inward of the periphery, which extend beyond the plane on which the periphery lies, such that the disk is supported by the protrusions when resting on a support surface, such as the ground, leaving the periphery elevated from the support surface.

18 Claims, 7 Drawing Sheets

FLYING DISK TOY

BACKGROUND OF THE INVENTION

The present invention relates to a flying disk, and more particularly to a flying disk of the type used for throwing between individual players for a game of catch, and for fetch play with pets.

With conventional disk designs, should the disk land on the ground, contact will be made between the outer rim of the disk and the ground surface on which it is supported, thereby making pickup difficult, either by a hand of the player, or in a dog's mouth.

Therefore, an object of the invention is to provide a flying disk which overcomes this and other drawbacks of the prior art.

SUMMARY OF THE INVENTION

In accordance with this and other objects of the invention, an embodiment of the invention includes a toy with a generally disk-shaped body, a periphery of which includes a lower edge which coincides generally with a plane. The disk-shaped body further includes one or a series of protrusions on an undersurface of the disk body, disposed radially inward of the periphery, which extend beyond the plane on which the lower edge of the periphery lies, such that the disk is supported by the protrusions when resting on a support surface, such as the ground, leaving the periphery elevated from the support surface.

In accordance with an advantageous embodiment, the protrusions are formed by projections of the disk body which leave openings (or indentations) above the protrusions, each of a size sufficient to allow a top mold half, during molded production with top and bottom mold halves being brought together and then released, to clear the openings and form the top surfaces of the protrusions within the indentations. By virtue of such configuration, a material thickness of the protrusions can advantageously be made comparable to a corresponding thickness of adjacent areas of the disk body, if so desired. This approach also advantageously allows multiple disks of like construction to nest when shipped or displayed, by allowing protrusions of one disk to be received in the openings (indentations) of another disk.

It is noted, however, that the protrusions can alternatively be made of solid material from an upper surface to the bottoms of the protrusions, leaving no indentations) without departure from the invention. Furthermore, rather than providing plural, circumferentially spaced-apart protrusions, a single circumferentially arranged protruding structure (i.e., generally ring-shaped or crescent-shaped) could be alternatively provided, which extends at least substantially around the disk, inset radially from the periphery.

The above, and other objects, features and advantages of the present invention will become apparent from the following description read in conjunction with the accompanying drawings.

DETAILED DESCRIPTION OF THE PREFERRED EMBODIMENT

Referring now to the figures, a first embodiment of a flying disk toy according to the invention is depicted. As shown therein, the toy, generally designated by the numeral 10, includes a generally disk-shaped body 1 which is advantageously, although not necessarily, shaped to provide aerodynamic lift (for example, having a generally convex upward facing surface and concave downwardly facing surface, or respective compound curved surfaces, as shown). A series of downward projections 2 are provided to said body 1, circumferentially spaced apart, and radially inset from an outermost peripheral rim 1*a* of the body 1. Advantageously, as shown, openings 3 corresponding positionally to the projections 2 are provided in the body 1, to allow structure of the mold in which the toy is molded to extend downwardly to a top surface of the projections 2, so as to permit control of a thickness of structure defining the projections 2.

Figure 3:
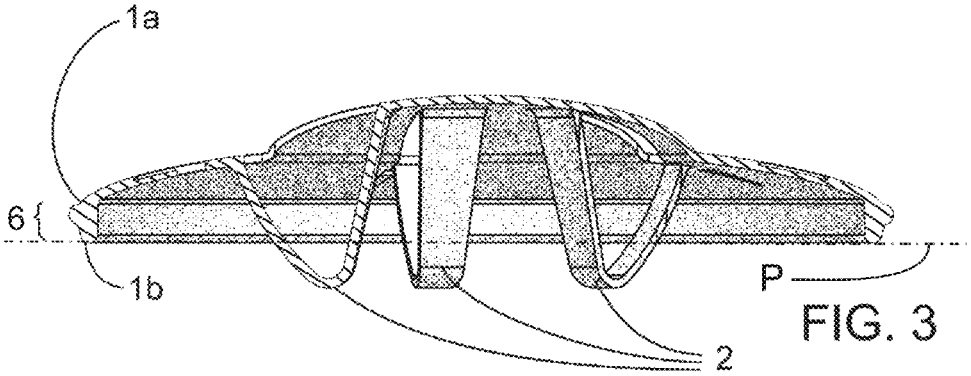
FIG. 3 is a cross-section taken along line 3-3 in FIG. 2.

The disk-shaped body 1 has a periphery 1*a* of which includes a lower edge 1*b* which lies generally on a plane P (see FIG. 3). A rim 6 of a selected height is advantageously provided as an option to inhibit flexing of the toy 10, particularly when the toy 10 is made of a soft natural or synthetic rubber composition.

It is noted that, for purposes herein, the terms "disk" or "disk-shaped" are defined to include any structure of generally rounded and relatively flattened configuration relative to a widened expanse, and can include structures having a perimeter which, while following the generally rounded path, can also be comprised of one or more straight or curved segments, as well as a disk structure which is optionally described by a smooth circular perimeter, as in the illustrated examples shown and described herein.

It is further noted that the terms "protrusions" and "projections" are used interchangeably to describe structure that extends generally outward of remaining structure.

In the embodiment shown, small openings 4 are optionally provided for accommodating packaging loop fasteners or other mounting elements therethrough, which serve to facilitate consumer packing of the disk, for example, for attaching a header card for peg mounting in a retail outlet. Also, decorative embossments 5 (as shown), raised extrusions, or other types of surface adornments can be provided to enhance the visual appeal of toy 10.

Figure 1:
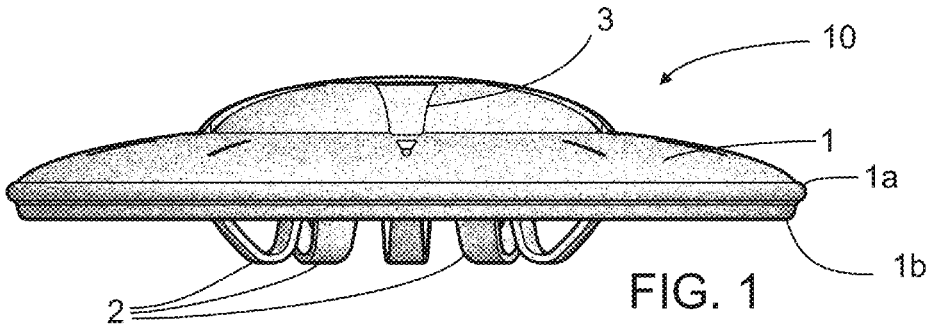
FIG. 1 is a side elevational view of a first embodiment of the invention.
Figure 2:
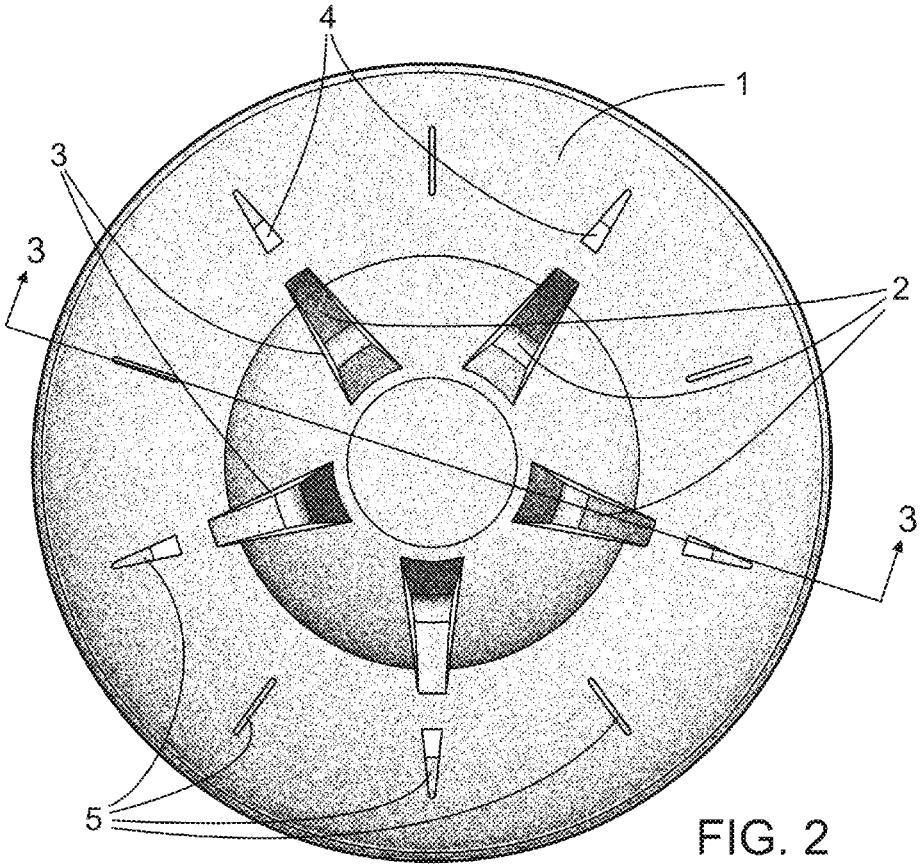
FIG. 2 is a top plan view of the embodiment of FIG. 1.
Figure 4:
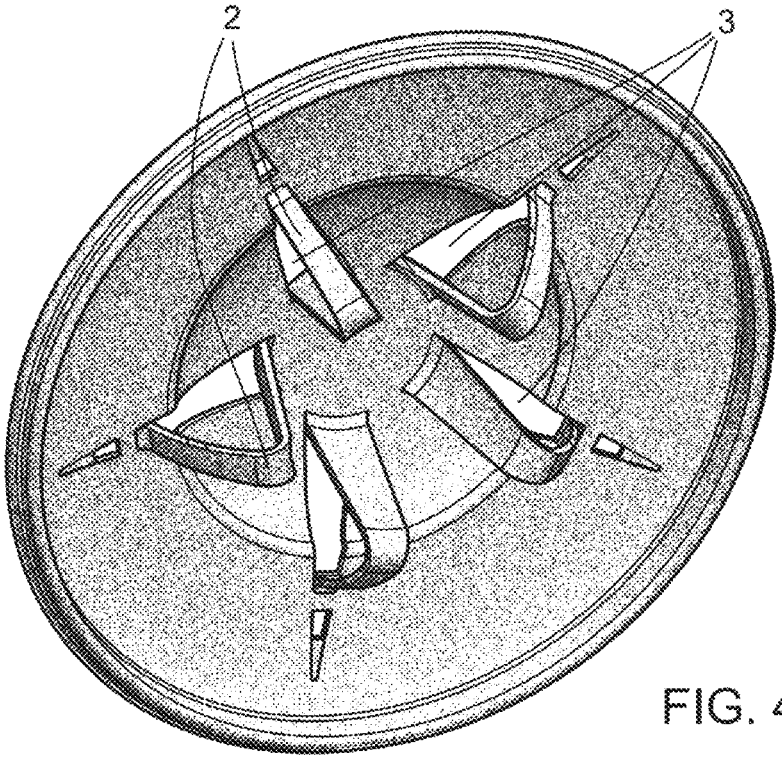
FIG. 4 is a bottom perspective view of the first embodiment.
Figure 5:
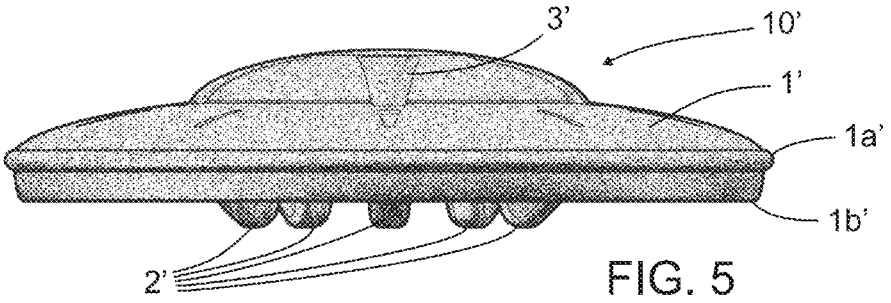
FIG. 5 is a side elevational view of a second embodiment of the invention.

While depicted generally as open "loops" in FIGS. 1, 3 and 4, the projections 2 can take any suitable form which is effective to support the disk when on a support surface, such as, for example, indented conical, cylindrical or other shaped projections, so as to keep the lower edge 1*b* of the periphery 1*a* of the disk spaced apart from the support surface, for facilitated pick-up by an individual or pet.

Alternative embodiments of other structural variations embraced within the contemplated scope of the invention are depicted in FIGS. 5-14, and which serve to exemplify the broad range of possible configurations that may be employed, without departure from the invention.

Figure 6:
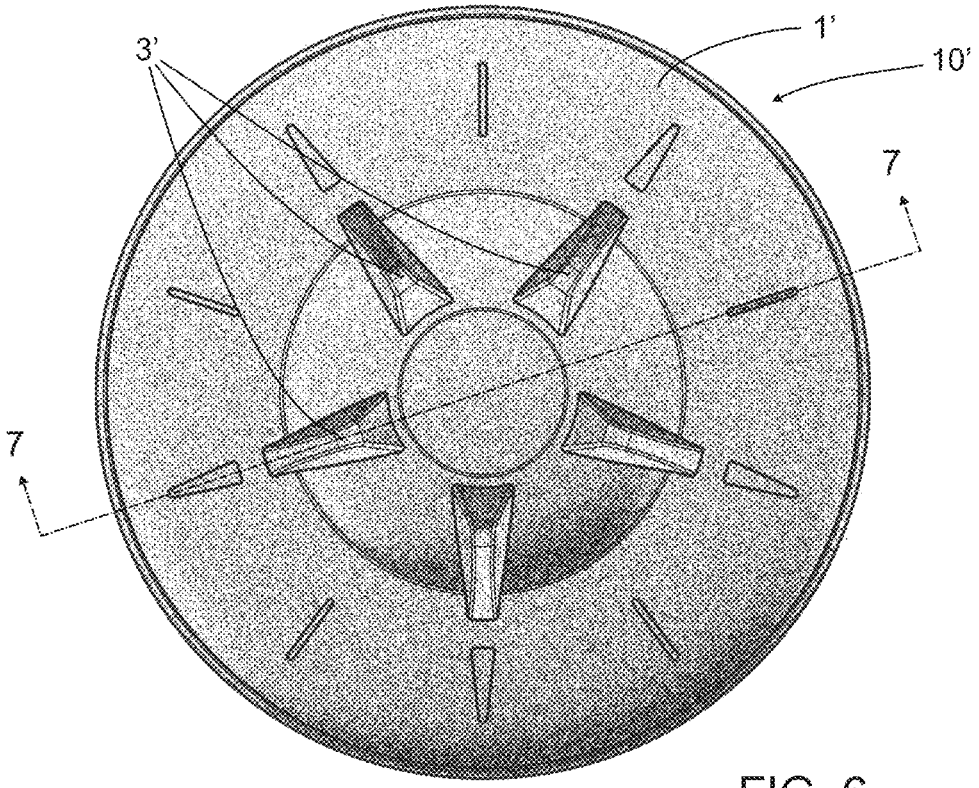
FIG. 6 is a top plan view of the embodiment of FIG. 5.
Figure 7:
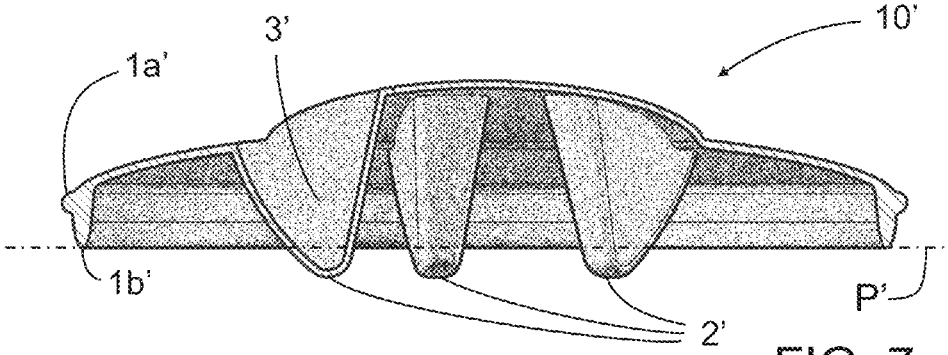
FIG. 7 is a cross-section taken along line 7-7 in FIG. 6.
Figure 8:
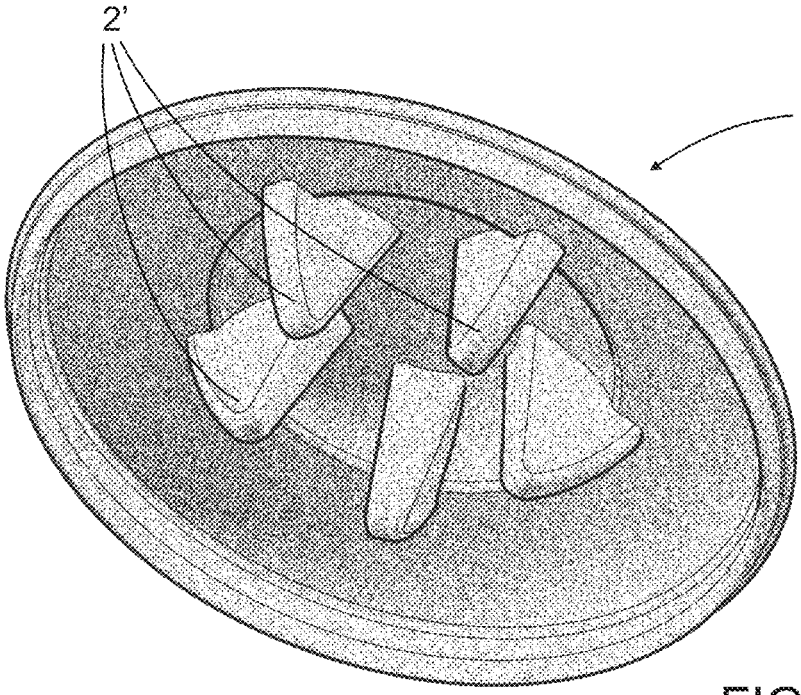
FIG. 8 is a bottom perspective view of the second embodiment.
Figure 9:
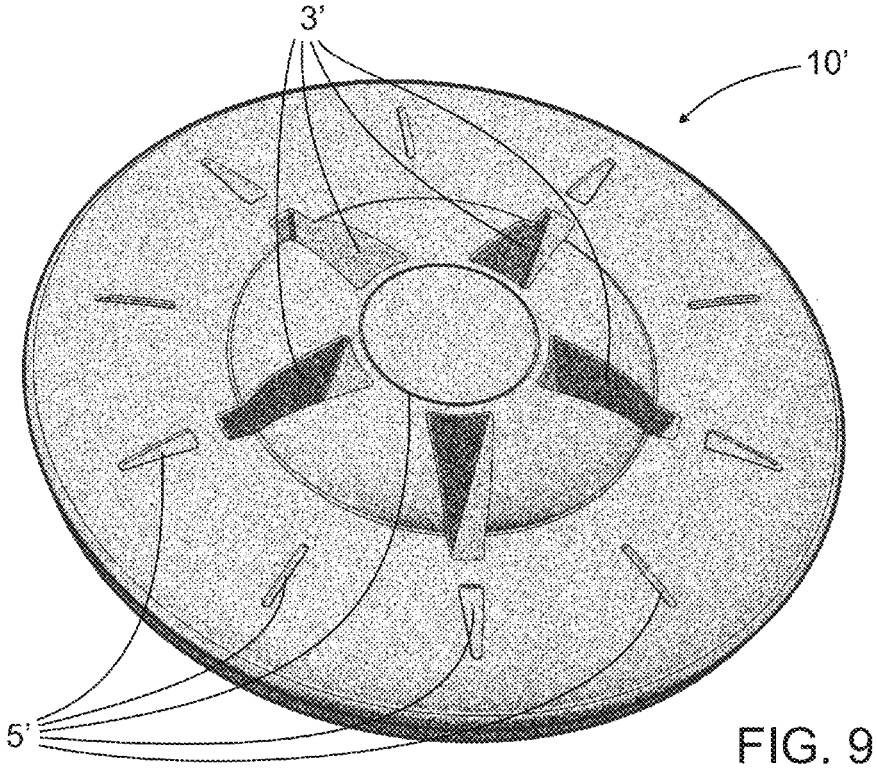
FIG. 9 is a top perspective view of the second embodiment.
Figure 10:
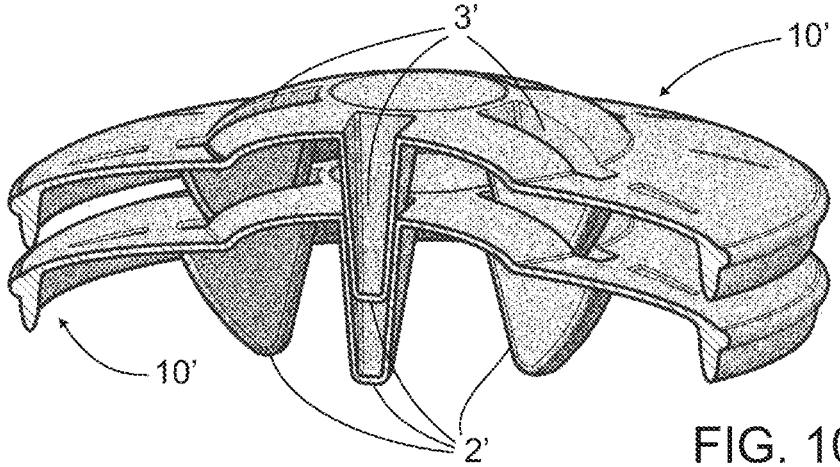
FIG. 10 is an explanatory view showing, in cross-section, two disks in accordance with the second embodiment in a nested stacked condition.
Figure 11:
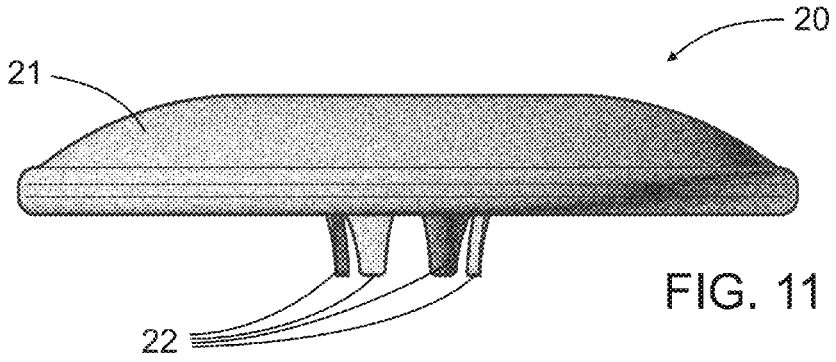
FIG. 11 is a side elevational view of a third embodiment of the invention.
Figure 12:
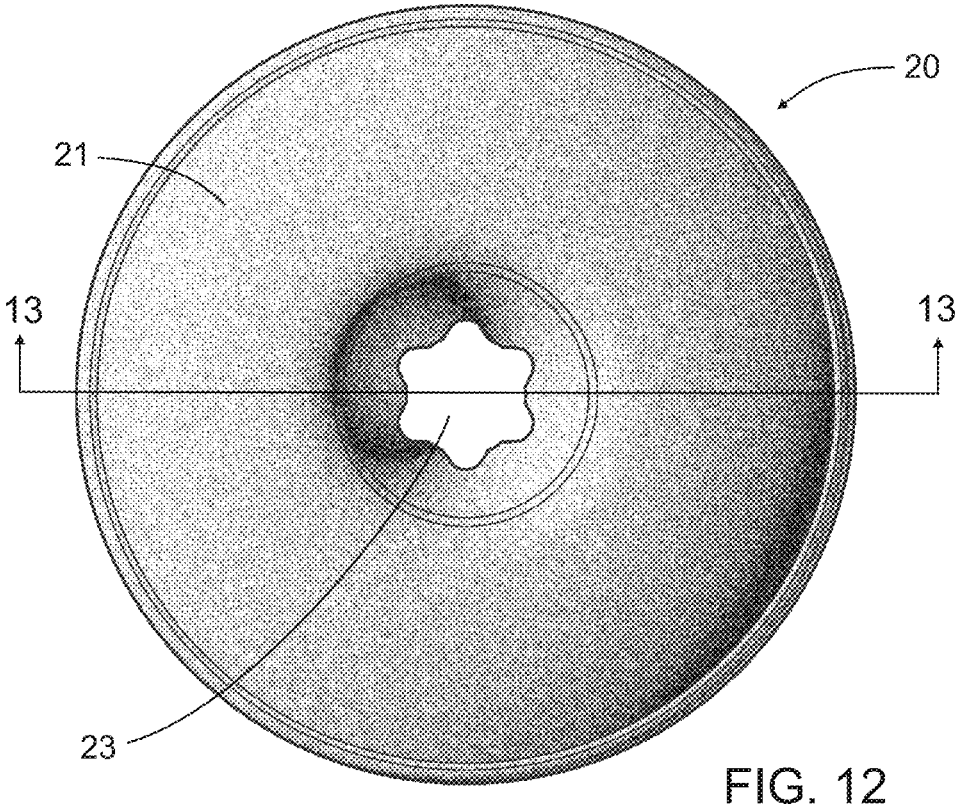
FIG. 12 is a top plan view of the embodiment of FIG. 11.

Turning now to FIGS. 5-9, a second embodiment of a disk-shaped toy is depicted, generally at 10'. The toy 10' includes a generally disk-shaped body 1', for example, as shown in FIG. 6. The open loop structure of projections 2 of the previously described first embodiment of FIGS. 1-4 is replaced with enclosed projections 2', provided in the form of protrusions advantageously presenting a material thickness defined by the material located between the downward facing surfaces of the projections 2' and corresponding indentations 3' formed from above. As such, if optionally so desired, a generally constant wall thickness defining a body of the disk-shaped toy 10' can be maintained, even in the region of the protrusions 2', by control of the internal geometry of the indentations 3' relative to the outer geometry of the protrusions 2'. This feature is depicted in the cross-sectional view of FIG. 7, in which a generally constant thickness of the material comprising the disk-shaped body 1' has been optionally maintained in the region of the projections 2'.

Use of enclosed projections 2' is thought to improve lift of the toy 10', hence increasing a throwing distance, and generally improving flight characteristics, by eliminating air passages between a bottom of the disk-shaped body 1' (for example, the concave side, when so configured) and a top thereof (for example the convex side, when so configured).

As with the first embodiment, multiple projections 2' are advantageously circumferentially spaced apart from one another, and are radially inset from an outermost peripheral rim 1*a'* of the body 1' and located radially outward of a center of body F. Additionally, a periphery 1*a'* of body 1' includes a lower edge 1*b'* which coincides generally with a plane P' (see FIG. 7). It is noted, however, that lower edge 1*b'* need not be entirely flat, but can include undulations, indentations, etc., which advantageously collectively lie commonly on plane P'.

As with the first embodiment, the body 1' is supported by the projections 2' when received on a generally planar support surface, such as the ground, leaving the periphery 1*a'* and lower edge 1*b'* elevated from the support surface on which the toy 10' is rested.

Decorative embossments 5' (as shown), raised extrusions, or other types of surface adornments can be provided to enhance the visual appeal of toy 10'.

As mentioned previously, according to the optional advantageous structure of the described first and second embodiments, multiple disk toys 10 or 10' of like construction are nestable when shipped or displayed for compact shipping/storage/store display, since projections 2 or 2' of one disk toy 10 or 10' are receivable in the indentation(s) 3 or 3' of another disk. This feature is exemplified in FIG. 10, in which two toys 10', 10' are shown nested, with the projections 2' of one toy 10' being received within the indentations of another toy 10'.

Referring now to FIGS. 11-14, a third embodiment of a flying disk toy is depicted, generally designated by the numeral 20. In this embodiment, the toy 20 includes a generally disk-shaped body 21 configured as an annular disk. To impart enhanced lift, the annular disk configuration of body 21 includes a convex upper surface and a concave lower surface, such that body 21 has the appearance and construction of a top half of a generally bisected toroid.

Figure 13:
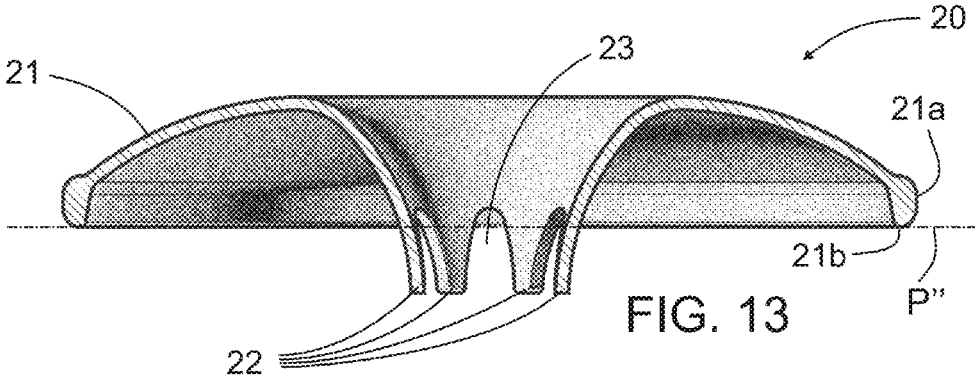
FIG. 13 is a cross-section taken along line 13-13 in FIG. 12.
Figure 14:
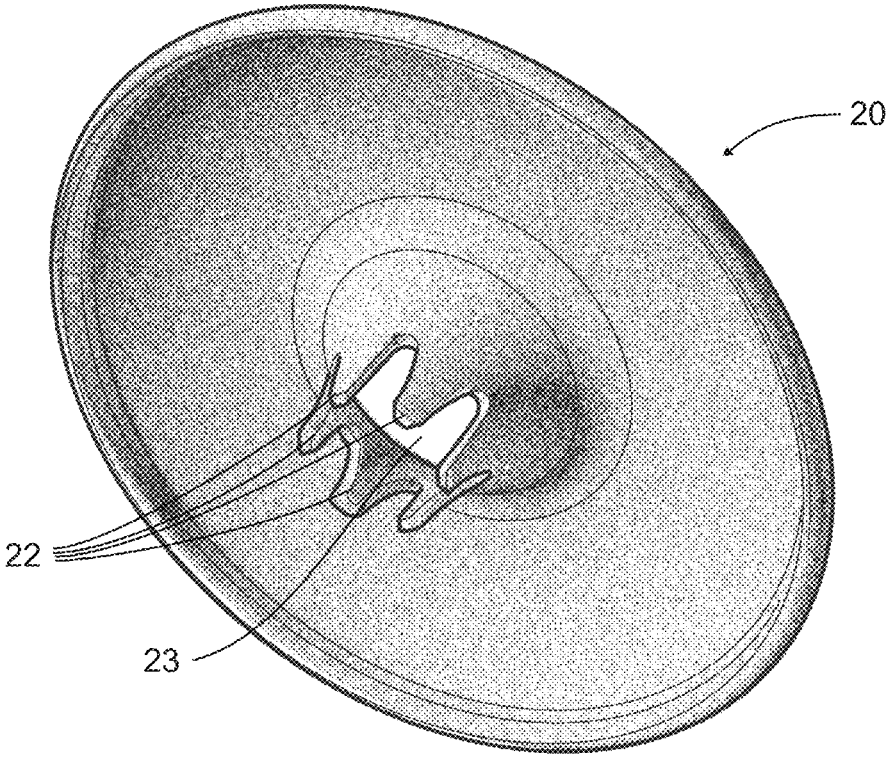
FIG. 14 is a bottom perspective view of the third embodiment.

Body 21 includes a periphery 21*a* having a lower edge 21*b* which lies generally coincident with a plane P" (see FIG. 13). The radially inward boundary of the annular disk of disk-shaped body 21 defines a central hole 23, and includes projecting structure which extends downward of the body 21, beyond plane P". Advantageously, as shown in the depictions of the third embodiment, the structure which extends downward of the plane P" includes a series of circumferentially spaced apart projections 22, for allowing crosswise passage of air when the toy 20 is thrown. However, this option need not be incorporated, and instead an uninterrupted ring or partial circumferential crescent shaped ground support could alternatively be provided without departure from the contemplated scope of the invention.

It is noted that by virtue of such configuration, like the first and second embodiment, the flying disk toy 20 of the third embodiment can be nested with other like toys 20 for compact storage/shipment thereof, with the structure which extends downward of the body 21 of a one of the toys 20 being received in the central hole 23 of another of the toys 20.

An alternative embodiment places one or more protrusions at a center of the disk body, the disk body thereby resting on the surface in a tilted orientation such that only one side of the disk is spaced apart from the ground (support surface). In a further embodiment, the same effect (i.e., tilted orientation) is achieved by protrusions set radially inward of the periphery which are not dispersed entirely around the circumference of the disk body.

The flying disk toy according to any embodiment of the invention can be made of any suitable material, for example, those already used for conventional flying disks, including for example, natural and synthetic rubber or plastic, and by any suitable production method, for example, injection or compression molding.

Having described preferred embodiments of the invention with reference to the accompanying drawings, it is to be understood that the invention is not limited to these precise embodiments, and that various changes and modifications may be effected therein by one skilled in the art without departing from the scope or spirit of the invention as defined in the appended claims.

What is claimed is:

1. A flying disk, comprising:

a generally disk-shaped body having a periphery; and at least one projection being disposed radially outward of a center of said body and radially inward from said periphery, said at least one projection extending downward of the body beyond a plane generally coincident with a lower edge of the periphery, there being an absence of structure extending below said plane in a central region of said body located radially inward of said at least one projection and in a peripheral region circumscribing said body and extending a distance radially inward of said periphery and radially outward of said at least one projection, such that the body is at least partially supported by said at least one projection when said body is received on a support surface.

2. A flying disk according to claim 1, wherein the at least one projection is formed so as to leave an opening or indentation above the projection having a size sufficient to allow a top mold half, during molded production with top and bottom mold halves being brought together and then released, to clear the opening or indentation and form a top surface of the at least one projection within the opening or indentation.

3. A flying disk according to claim 1, wherein the at least one projection includes multiple circumferentially spaced-apart protrusions having discrete terminal ends.

4. A flying disk according to claim 3, wherein said multiple circumferentially spaced-apart protrusions include an open loop configuration.

5. A flying disk according to claim 1, wherein said generally disk-shaped body includes openings for accommodating packaging loop fasteners or other mounting elements therethrough.

6. A flying disk according to claim 1, wherein said generally disk-shaped body is comprised of an elastomeric material.

7. A flying disk according to claim 1, wherein said generally disk-shaped body includes a generally convex upward facing surface and generally concave downwardly facing surface, said upward facing surface being comprised of concentrically arranged compound curved surfaces.

8. A flying disk according to claim 1, wherein said generally disk-shaped body includes an annular shape comprising a radially inward boundary defining a central hole and a periphery defined by a radially outward boundary, said periphery having a lower edge which lies generally coincident with a plane, said radially inward boundary of the disk-shaped body including structure which extends downward of the body beyond the plane and which comprises said at least one projection.

9. A flying disk, comprising:

a generally disk-shaped body having a periphery; and at least one projection being disposed radially outward of a center of said body which extends downward of the body beyond a plane generally coincident with a lower edge of the periphery, there being an absence of structure extending below said plane in a central region of said body located radially inward of said at least one projection, such that the body is at least partially supported by said at least one projection when said body is received on a support surface, and at least a portion of the lower edge of the periphery is elevated above the support surface and spaced apart therefrom, the at least one projection including multiple circumferentially spaced-apart protrusions having discrete terminal ends, said multiple circumferentially spaced-apart protrusions including enclosed projections presenting a wall thickness defined by material comprising the body which is located between downward facing surfaces of the enclosed projections and inner surfaces of corresponding indentations in said enclosed projections extending from above.

10. A flying disk, comprising:

a body including a widened expanse presented a periphery having a generally rounded shape and a relatively flattened configuration relative to said widened expanse, said periphery having a lower edge; and at least one projection being disposed radially outward of a central region of the widened expanse of said body and radially inward of a periphery thereof, said at least one projection extending beyond a lowermost part of said lower edge of the periphery and a lowermost part of said central region such that the body is at least partially supported by said at least one projection when said body is received on a support surface.

11. A flying disk according to claim 10, wherein at least one of said at least one projection includes an opening or indentation above said at least one projection having a size sufficient to allow a top mold half, during molded production with top and bottom mold halves being brought together and then released, to clear the opening or indentation and form a top surface of the at least one projection within the opening or indentation.

12. A flying disk according to claim 10, wherein said at least one projection includes multiple circumferentially spaced-apart protrusions having discrete terminal ends.

13. A flying disk according to claim 10, wherein said body includes a generally convex upward facing surface and generally concave downwardly facing surface, said upward facing surface being comprised of concentrically arranged compound curved surfaces.

14. A flying disk according to claim 10, wherein said body is comprised of an elastomeric material.

15. A flying disk according to claim 14, wherein said elastomeric material comprises natural rubber.

16. A flying disk, comprising:

a body including a widened expanse presented a periphery having a generally rounded shape and a relatively flattened configuration relative to said widened expanse, said periphery having a lower edge; and at least one projection being disposed radially outward of a central region of the widened expanse of said body and radially inward of a periphery thereof, said at least one projection extending beyond a lowermost part of said lower edge of the periphery and a lowermost part of said central region such that the body is at least partially supported by said at least one projection when said body is received on a support surface whereby at least a portion of the lower edge of the periphery is elevated, in a spaced apart condition, above the support surface, said at least one projection including multiple circumferentially spaced-apart art protrusions having discrete terminal ends, said multiple circumferentially spaced-apart protrusions including enclosed projections presenting a wall thickness defined by material comprising the body which is located between downward facing surfaces of the enclosed projections and inner surfaces of corresponding indentations in said enclosed projections extending from above.

17. A flying disk, comprising:

a body including a widened expanse presented a periphery having a generally rounded shape and a relatively flattened configuration relative to said widened expanse, said periphery having a lower edge; and at least one projection being disposed radially outward of a central region of the widened expanse of said body and radially inward of a periphery thereof, said at least one projection extending beyond a lowermost part of said lower edge of the periphery and a lowermost part of said central region such that the body is at least partially supported by said at least one projection when said body is received on a support surface whereby at least a portion of the lower edge of the periphery is elevated, in a spaced apart condition, above the support surface, said body including an annular shape comprising a radially inward boundary defining a central hole and a periphery defined by a radially outward boundary, said periphery having a lower edge which is generally coincident with a plane, said radially inward boundary of the body including structure which extends downward of the body beyond the plane and which comprises said at least one projection.

18. A flying disk, comprising:

a body including a widened expanse presented a periphery having an encircling outer shape and a relatively flattened configuration relative to said widened expanse, said body being comprised of a shaped contiguous layer of material, said periphery having a lower edge; and at least one projection being disposed radially outward of a central region of the widened expanse of said body and radially inward of a periphery thereof, extending beyond a lowermost part of said lower edge of the periphery and a lowermost part of said central region such that the body is at least partially supported by said at least one projection when said body is received on a support surface whereby at least a portion of the lower edge of the periphery is elevated, in a spaced apart condition, above the support surface, said at least one projection being defined by a localized configuration of said layer of material which includes an indented portion on a top surface of said layer of material and a protrusion on a bottom surface thereof.

* * * * *